United States Patent [19]

Förster et al.

[11] Patent Number: 4,602,677

[45] Date of Patent: Jul. 29, 1986

[54] CONVECTION COOLER

[75] Inventors: Manfred Förster, Essen; Walter Hoff, Oberhausen, both of Fed. Rep. of Germany

[73] Assignee: Deutsche Babcock Werke Aktiengesellschaft, Oberhausen, Fed. Rep. of Germany

[21] Appl. No.: 684,028

[22] Filed: Dec. 20, 1984

[30] Foreign Application Priority Data

Feb. 25, 1984 [DE] Fed. Rep. of Germany ..... 3406893

[51] Int. Cl.[4] ..... F28D 1/06

[52] U.S. Cl. ..... 165/75; 122/392

[58] Field of Search ..... 165/74, 75, 72, 73; 122/392

[56] References Cited

U.S. PATENT DOCUMENTS

| | | | |
|---|---|---|---|
| 2,940,430 | 6/1960 | Hardgrove | 122/392 |
| 2,960,972 | 11/1960 | Schaap | 122/392 X |
| 3,163,154 | 12/1964 | Cartieri et al. | 122/392 |
| 4,456,057 | 6/1984 | Melcer | 122/392 X |
| 4,466,384 | 8/1984 | Maurer et al. | 122/392 |

*Primary Examiner*—Albert W. Davis, Jr.
*Assistant Examiner*—Peggy Neils
*Attorney, Agent, or Firm*—Max Fogiel

[57] ABSTRACT

Convection cooler for cooling a gas produced under elevated pressure in a gasification reactor. The cooler has a pressure-tight jacket provided with a removable cover. Within the jacket there is an insert arranged spaced apart therefrom. The insert has tubes joined in gastight manner to each other by way of webs. Contact heating surfaces are arranged in the insert which is supported on the pressure jacket. The insert is closed at its upper end by way of a ceiling constructed of tubes. The contact heating surfaces are joined to support tubes. The upper ends of the contact heating surfaces and the support tubes are passed through the ceiling. The support tubes, the contact heating surfaces, and the ceiling are suspended from the cover independently of the insert. Wall soot blowers are arranged fixedly superimposed at several levels in the insert.

11 Claims, 4 Drawing Figures

CONVECTION COOLER

BACKGROUND OF THE INVENTION

The present invention relates to a convection cooler, and in particular, one for cooling a gas produced in a gasification reactor under elevated pressure.

Such a convection cooler is known from the German patent No. 32 08 421. In this convection cooler a part of the bundle heating surfaces, which are arranged within the insert, are suspended from the removable lid of the container and can be pulled out of the insert. The further bundle heating surfaces provided in the lower part of the insert are connected to the insert. Water-cooled soot blowers, which are fixedly attached to the bundle heating surfaces, are used for cleaning the removable bundle heating surfaces. This arrangement, as such, is effective, but can be improved in some respects.

From U.S. Pat. No. 2,940,430 a coal combustion boiler is known, which has a primary combustion chamber and, adjoining thereon, a secondary combustion chamber, in which platen walls are suspended as superheaters. Deposits can form at the lower edge of this superheater. These deposits have to be removed by way of soot blowers. These soot blowers are provided as fixed-wall soot blowers, of which the outlet openings extend, at the height of the lower edge of the superheaters, through the tube wall of the secondary combustion chamber.

Reaction gases resulting from a gasification of solid or liquid carbon-containing energy carriers, in particular of coal, as well as residues of production processes (for example petroleum coke), contain constituents, which act very corrosively on the conventional boiler tube steels. The corrosive effect of such constituents increases with increasing pressure on the gas side and with increasing temperature of the tube wall. The heating surfaces, which are arranged as superheaters, or as evaporators at high vapor pressures or as economizers at end temperatures above 280° C., are particularly attacked. The application of high value Chrome/Nickel steels or Chrome/Nickel alloys makes such coolers much more expensive, without reliably solving the problem. Furthermore, in many cases the susceptibility of these materials is increased, as compared to an unintended dropping below the dew point coupled with most acid reacting fuel ashes and/or relative to chloride corrosion.

On the other hand, in the case of increased gas side pressures, the heating surfaces have to be located in a pressure vessel, whereby the accessibility of the heating surfaces is made more difficult. In order to keep the dimensions of the pressure vessel as small as possible and to avoid having moving parts within the pressure vessel, the soot blowers required for cleaning the heating surfaces in the gasification of coal must be provided as fixed soot blowers, whereby in the known constructions the accessibility is further made more difficult.

SUMMARY OF THE INVENTION

The present invention, therefore, has the object to provide a convection cooler of the aforegoing character which, as a whole, is more suited for repairwork.

This object is achieved by providing a convection cooler in which the insert and the soot blower system for a unit, on the one hand, whereas the contact heating surfaces together with the support tubes, the ceiling, and the associated collectors and connection conduits, form a unit within the insert, on the other hand. Both units are connected, depending on the water/vapor side connection, only at the lower end of the convection cooler by means of some connection conduits and/or, possibly, support pipe connections. Therewith only a few separation steps are sufficient in the lower part of the jacket, which has a good accessibility, in order to obtain a complete separation of both units. As the soot blower system that is provided has no inwardly projecting parts and the insert can be supported separately, therefore, after loosening of the jacket flange by lifting the cover, the contact heating surfaces, together with the ceiling, collectors and connection conduits, can be pulled and can be inspected and repaired outside of the convection cooler. Simultaneously the insert is also easily accessible within the pressure jacket.

In addition to improved repairability, the convection cooler, in accordance with the present invention, has also a reduction in the constructional height whereby it provides a saving in weight. The reduction of the constructional height results, on the one hand, from the condition that, by eliminating the fixed soot blower lances passing through the contact heating surfaces, the intermediate spaces required for receiving these lances are no longer necessary. On the other hand, as compared to convection coolers with contact heating surfaces in the wall of the insert, which need not be removed, no space is required for entry doors.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
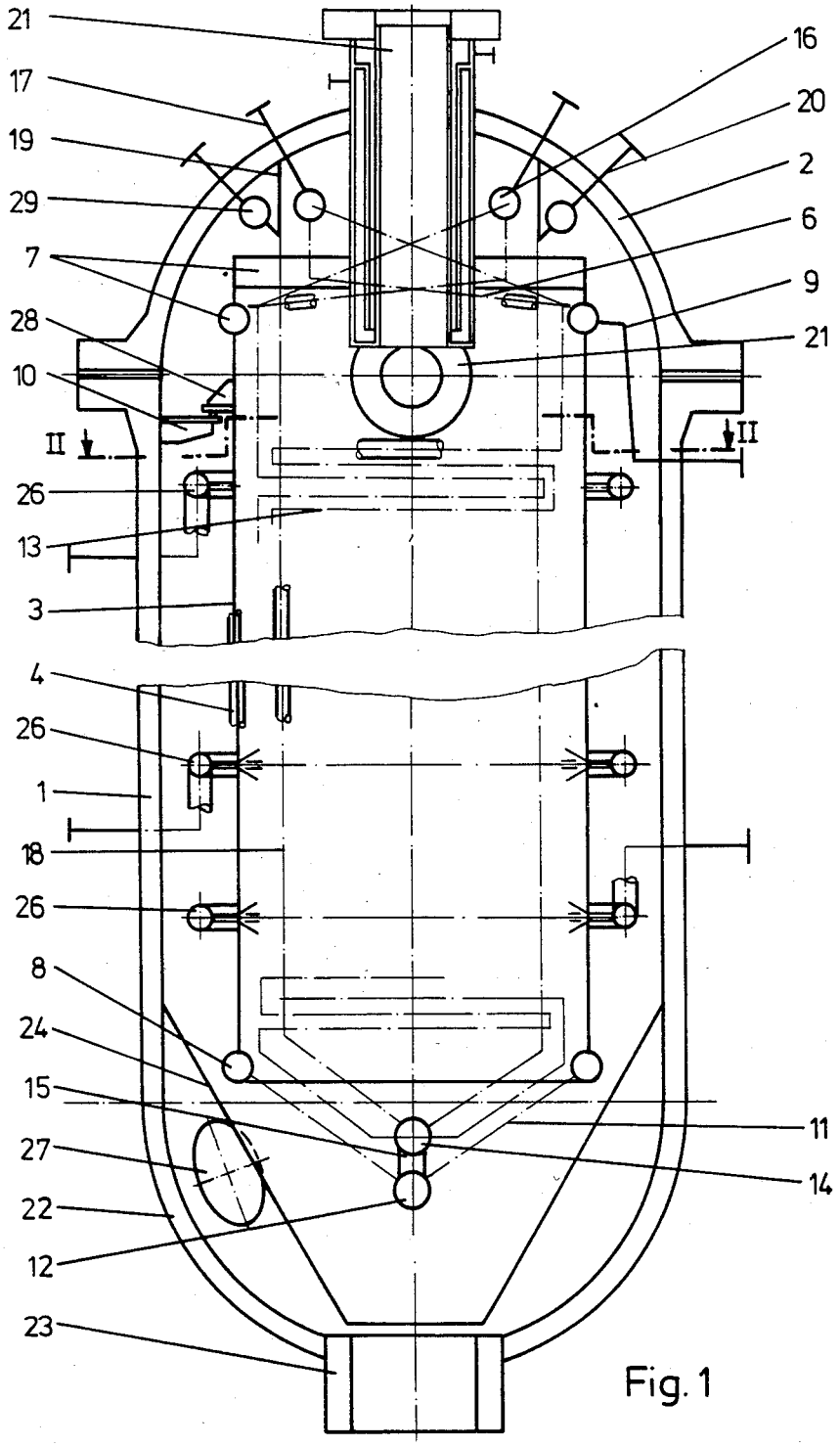
FIG. 1 shows a longitudinal section through a convection cooler in accordance with the present invention.
Figure 2:
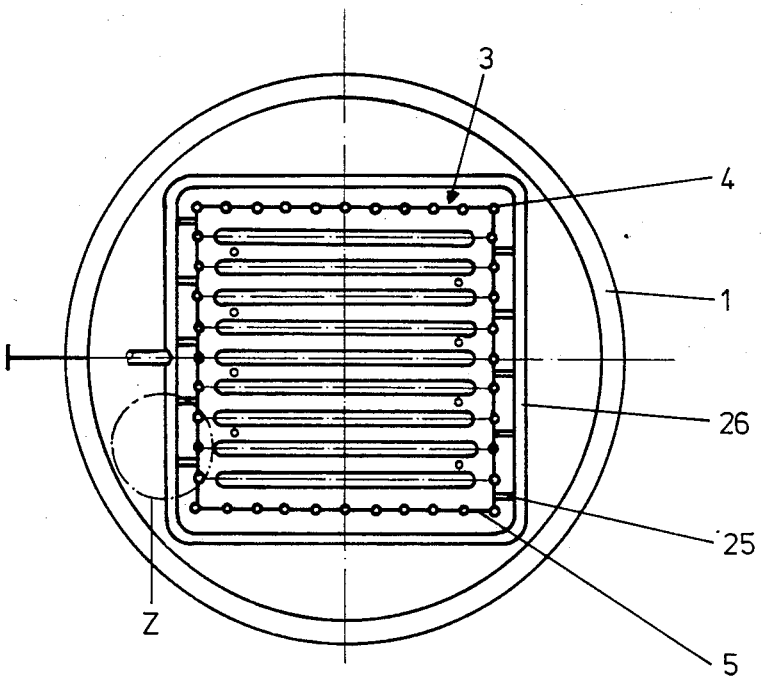
FIG. 2 shows a section II in FIG. 1.
Figure 3:
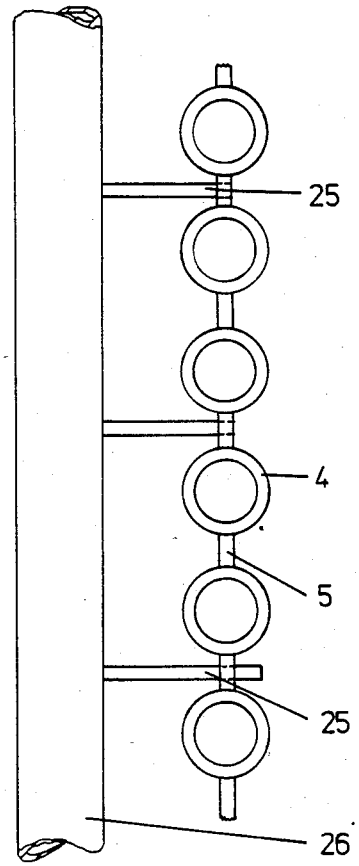
FIG. 3 shows a detail Z from FIG. 2.

The illustrated convection cooler is arranged as an evaporator or as an economizer and serves for the cooling of a gas, which is produced in a gasification reactor under elevated pressure. A part of its heat may already be withdrawn from the gas in an upstream radiation cooler prior to entry into the head of the convection cooler. The convection cooler can also be used for cooling of gases, which originate from another source and in particular contain dust and corrosive constituents.

The convection cooler consists of a pressure-tight jacket 1, which is closed by means of a removable cover 2. Within the jacket 1 there is an insert 3 spaced from jacket 1. This insert is formed by way of tubes 4. The tubes 4 are welded together by means of intermediate webs 5 creating a gastight gas shaft. The insert 3 has a polygonal, equilateral, preferably quadratic cross-section. It is open toward the bottom and is closed above by means of a ceiling 6.

The tubes 4 of each side of the insert 3 are joined to a lower and an upper connector 7, 8. The upper connectors 7 are connected to supply conduits 9, which extend through the jacket 1. Brackets 10 are attached on the inner side of the jacket 1, on which the claws 28 rest. The claws 28 are attached to the insert 3 so that the insert is supported in the upper part of the jacket 1. The lower collectors 8 are connected to a central collector 12 by means of connection tubes 11.

Contact heating surfaces 13 in the form of flat, plate-shaped tube bundles, are housed within the insert 3. These bundles extend over the full height of the insert 3. The tubes of all contact surfaces 13 terminate into a common collector 14, which is arranged transversely to the contact heating surfaces 13 below the insert 3. This common collector 14 is connected by way of a connection piece 15 to the central collector 12 of the side walls of the insert 3. The upper ends of the tubes of the contact heating surfaces 13 are led to the collectors 16. Therewith these tubes are bent such that they form the ceiling 6 of the insert 3. The collectors 16 are connected to exhaust conduits 17, which extend through the cover 2, to the outside.

The contact heating surfaces 13 are suspended from support tubes 18, which in turn are supported by means of support brackets 19 from the cover 2. The support tubes 18 extend over the full height of the contact heating surfaces 13 and terminate into the collector 14 in the lower part of the jacket 1. The support tubes 18 are connected to the entry collectors 29 and are fed from supply conduits 20, which extend through the cover 2.

The gas, which is to be cooled, is supplied by way of one or more transfer conduits to the convection cooler. The transfer conduits are connected to cooled entry tubes 21, which terminate into the upper part of the insert 3. A gas discharge pipe 23 is provided below the insert 3 in a floor, which closes off the jacket 1. A plate funnel 24 is located above the gas exit pipe 23. The gas therewith flows through the insert 3 from above to below along the contact heating surfaces 13, and passes out at the bottom through the plate funnel 24.

Wall soot blowers are provided on several levels above each other in two oppositely situated side walls of the insert 3 for cleaning the contact heat surfaces 13. The wall soot blowers consist of nozzles 25, which extend through the webs 5 between the tubes 4 of the insert 3. The outlet openings of the nozzles 25 can terminate on the level of the webs 5, or project slightly above the tubes 4 of the insert 3. The nozzles 25 are fed with a blow medium from conduits 26. These conduits are located outside of the insert 3. According to FIG. 1, the nozzles 25 of one level, in each case, can be connected to its own supply conduit 26. Also the nozzles on several levels can be connected to a common supply: The nozzles 25 are arranged at two opposite sides of the insert 3, and are staggered relative to each other in the direction of a channel between two neighboring contact heating surfaces 13. The support tubes 18 in each case are thereby provided on the side of the insert 3 facing away from the nozzles 25. The nozzles 25 are preferably aligned downward in the direction of the flowing gas.

On the jacket 1, manholes 27 are provided, by way of which the inner space of the convection cooler can be reached. Sufficient space is present between the insert 3 and the jacket 1 for performing work.

Figure 4:
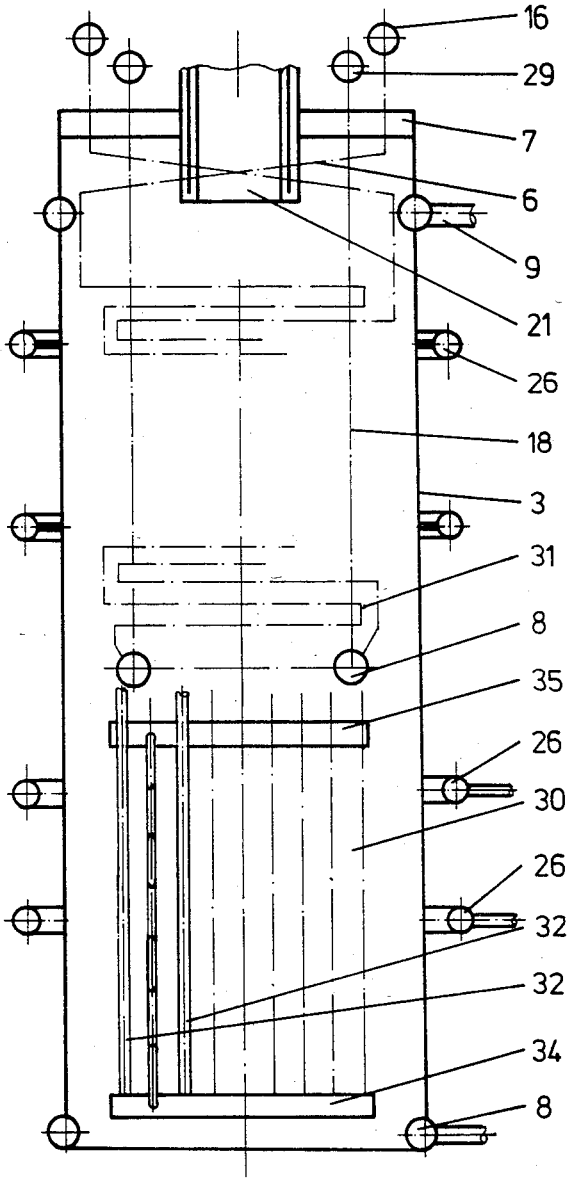
FIG. 4 shows a longitudinal section through another embodiment in accordance with the present invention.

The bundle heating surfaces 13 can be arranged only as superheaters, as evaporators or as economizers. Such an arrangement is obtainable by way of the convection cooler illustrated in FIG. 1. The contact heating surfaces 13 can also represent two heating surface types, for example evaporator and overheater. Such a case is shown in FIG. 4. Hereby the bundle heating surfaces are divided into two partial heating surfaces 30, 31, which are arranged above each other within the insert 3. With the exception of the shorter vertical extension, the layout of the upper partial heating surfaces 31 correspond to the arrangement of the bundle heating surfaces 13 according to FIG. 1.

The lower partial heating surfaces 30 consist of plate-shaped tube bundles, which are displaced about 90° relative to the plate-shaped pipe bundles of the upper partial heating surfaces 31. The suspension tubes 32, suspending the lower partial heat surfaces 30, are passed through the channels between the upper partial heating surfaces 31 and are suspended at the cover 2. The tubes of the lower partial heating surfaces 30 are joined at the lower and upper collectors 34, 35 and flow takes place from above to below.

The described convection cooler is designed such that, in a simple manner, repairs can be performed on the contact heating surfaces 13 within the convection cooler. For this purpose at first the flange of the jacket 1 and the cover 2 are loosened. In the lower part of the convection cooler the support tubes 18 and the connection piece 15 between the common collector 14 of the contact heating surfaces 13 and the central collector 12 of the insert 3 are to be separated. Thereafter the support tubes 18 and the contact heating surfaces 13, connected therewith, can be removed from the surrounding insert 3 together with the cover 2. The removal with the contact heating surfaces is not hindered because the soot blowers, as wall soot blowers, are fitted securely in the insert 3, and the supply and withdrawal conduits to the contact heating surfaces 13 do not extend through the wall of the insert 3.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

SUMMARY

The convection cooler consists of a jacket (1) and a cooled insert (3) arranged spaced apart therefrom, in which insert contact heating surfaces (13) are fitted removably. The wall of the insert (3) is provided with soot blowers (FIG. 1).

What is claimed is:

1. Convection cooler for cooling a gas produced under elevated pressure in a gasification reactor, comprising: a pressure tight jacket having a removable cover; an insert arranged in said jacket and spaced apart from said jacket; said insert comprising tubes joined gastight to each other by webs; contact heating surfaces arranged in said insert, said insert being supported on said pressure jacket; a ceiling of bent-out tubes for closing said insert at its upper end; support tubes joined to said contact heating surfaces; upper ends of said contact heating surfaces and said support tubes being passed through said ceiling; said support tubes, said contact heating surfaces and said ceiling being suspended in said pressure jacket from said cover independent of said insert so that said ceiling of tubes can be separated from said insert outside of said pressure jacket; wall soot blowers arranged inside the wall of said insert and fixedly superimposed at several levels in said insert, said blowers being uncooled having nozzles with exit openings passing through said webs between said tubes, said blowers being joined to supply tubes located outside of said insert.

2. Convection cooler according to claim 1, wherein said wall soot blowers of several levels are joined to a common supply tube.

3. Convection cooler according to claim 1, wherein said nozzles are displaced relative to each other in walls of said insert, said walls being located opposite to each other.

4. Convection cooler according to claim 1, wherein said nozzles are aligned in flow direction of the gas.

5. Convection cooler according to claim 1, including supply conduits to said insert and extending through the wall of said jacket.

6. Convection cooler according to claim 1, including a connection conduit for connecting an outlet of said tubes of said insert to an inlet of said contact heating surfaces and to said support tubes, said connection conduit being located in the lower part of said jacket.

7. Convection cooler according to claim 1, including at least one cooled entry stub pipe for the gas and extending into a space surrounded by said insert.

8. Convection cooler according to claim 1, including bundle heating surfaces sub-divided into at least two partial heating surfaces, each surface having its own collector, flow occurring from below to above past tubes of said partial heating surfaces, discharge conduits of said partial heating surfaces extending through said ceiling.

9. Convection cooler according to claim 8, wherein two partial heating surfaces are displaced by 90° relative to each other.

10. Convection cooler according to claim 1, wherein said ceiling of said insert is formed by contact heating surfaces.

11. Convection cooler for cooling a gas produced under elevated pressure in a gasification reactor, comprising: a pressure tight jacket having a removable cover; an insert arranged in said jacket and spaced apart from said jacket; said insert comprising tubes joined gastight to each other by webs; contact heating surfaces arranged in said insert, said insert being supported on said pressure jacket; a ceiling of bent-out tubes for closing said insert at its upper end; support tubes joined to said contact heating surfaces; upper ends of said contact heating surfaces and said support tubes being passed through said ceiling; said support tubes, said contact heating surfaces and said ceiling being suspended in said pressure jacket from said cover independent of said insert so that said ceiling of tubes can be separated from said insert outside of said pressure jacket; wall soot blower arranged inside the wall of said insert and fixedly superimposed at several levels in said insert, said blowers being uncooled having nozzles with exit openings passing through said webs between said tubes, said blowers being joined to supply tubes located outside of said insert; said wall soot blowers of several levels being joined to a common supply tube; said nozzles being displaced relative to each other in walls of said insert, said walls being located opposite to each other; said nozzles being aligned to flow direction of the gas; supply conduits to said insert and extending through the wall of said jacket; a connection conduit for connecting an outlet of said tubes of said insert to an inlet of said contact heating surfaces and to said support tubes, said connection conduit being located in the lower part of said jacket; at least one cooled entry stub pipe for the gas and extending into a space surrounded by said insert; bundle heating surfaces subdivided into at least two partial heating surfaces, each surface having its own collector, flow occurring from below to above past tubes of said partial heating surfaces, discharge conduits of said partial heating surfaces extending through said ceiling.

* * * * *